US005829240A

United States Patent [19]

Benson et al.

[11] Patent Number: 5,829,240

[45] Date of Patent: Nov. 3, 1998

[54] SPINNING RING HAVING IMPROVED TRAVELER BEARING SURFACE

[75] Inventors: Rio H. Benson, Gastonia; Gereon E. Poquette, Denver, both of N.C.

[73] Assignee: A. B. Carter, Inc., Gastonia, N.C.

[21] Appl. No.: 822,151

[22] Filed: Mar. 17, 1997

[51] Int. Cl.[6] ..... D01H 7/60

[52] U.S. Cl. ..... 57/125; 57/119; 57/136; 57/137

[58] Field of Search ..... 57/119, 124, 125, 57/126, 136, 137

[56] References Cited

U.S. PATENT DOCUMENTS

| | | | |
|---|---|---|---|
| 273,090 | 2/1883 | Husband | 57/119 |
| 1,595,858 | 8/1926 | Crompton | 57/119 |
| 2,194,930 | 3/1940 | Feen | 57/119 |
| 2,683,346 | 7/1954 | Pieper | 57/119 |
| 2,798,357 | 7/1957 | Stahli | 57/119 |
| 3,118,272 | 1/1964 | Clapp | 57/120 |
| 3,343,362 | 9/1967 | Lunsford | 57/119 |
| 3,421,307 | 1/1969 | Lunsford | 57/119 |
| 3,583,713 | 6/1971 | Sugahara | 277/235 A |
| 3,806,139 | 4/1974 | Suzuki et al. | 277/235 A |
| 3,932,228 | 1/1976 | Sugiyama et al. | 204/26 |
| 4,079,579 | 3/1978 | Cory | 57/125 |
| 4,092,226 | 5/1978 | Laing et al. | 204/51 |
| 4,308,715 | 1/1982 | Staehli | 57/119 |
| 4,366,034 | 12/1982 | Ricks et al. | 204/32 R |
| 4,406,756 | 9/1983 | Baranyi | 204/51 |
| 4,677,817 | 7/1987 | Kanai | 57/125 |
| 4,698,958 | 10/1987 | Nakano et al. | 57/119 |
| 4,717,456 | 1/1988 | Chessin et al. | 204/34 |
| 4,731,166 | 3/1988 | Jones | 204/34 |
| 4,885,905 | 12/1989 | Maruta et al. | 57/119 |
| 5,086,615 | 2/1992 | Bodnar | 57/119 |
| 5,175,988 | 1/1993 | Kibe | 57/119 |
| 5,313,773 | 5/1994 | Poquette et al. | 57/125 |
| 5,584,168 | 12/1996 | Artzt et al. | 57/119 |

FOREIGN PATENT DOCUMENTS

| | | | |
|---|---|---|---|
| 3839920 | 6/1989 | Germany . | |
| 55-40843 | 3/1980 | Japan | 57/119 |
| 60-2719 | 1/1985 | Japan | 57/119 |
| 60-2720 | 1/1985 | Japan | 57/119 |
| 63-315617 | 12/1988 | Japan | 57/119 |
| 63-315618 | 12/1988 | Japan | 57/119 |
| 1-292123 | 11/1989 | Japan . | |
| 3-90635 | 4/1991 | Japan . | |
| 3-174024 | 7/1991 | Japan . | |
| 4-82923 | 3/1992 | Japan . | |
| 5-106124 | 4/1993 | Japan . | |
| 5-93320 | 4/1993 | Japan . | |
| 5-117927 | 5/1993 | Japan | 57/120 |
| 5-186917 | 7/1993 | Japan | 57/119 |
| 5-195342 | 8/1993 | Japan | 57/119 |
| 5-302223 | 11/1993 | Japan | 57/119 |
| 5-331721 | 12/1993 | Japan | 57/119 |
| 6-158443 | 6/1994 | Japan . | |
| 6-173127 | 6/1994 | Japan . | |
| 15134 | 9/1890 | United Kingdom . | |
| WO 80/00718 | 4/1980 | WIPO | 57/119 |

OTHER PUBLICATIONS

*Hard Chromium Plating,* H. Chessin et al., *Metals Handbook*, Ninth Edition, vol. 5, "Surface Cleaning, Finishing, ad Coating", pp. 170–187.

*Primary Examiner*—William Stryjewski
*Attorney, Agent, or Firm*—Bell Seltzer Intellectual Property Law Group of Alston & Bird LLP

[57] ABSTRACT

The invention provides spinning rings for textile spinning processes having an improved bearing surface formed of a coating of hard nodular chromium which is applied by an electrodeposition process. The spinning rings of the invention can increase the life of travelers that ride on the spinning ring and can provide for high productivity spinning processes.

14 Claims, 5 Drawing Sheets

SPINNING RING HAVING IMPROVED TRAVELER BEARING SURFACE

FIELD OF THE INVENTION

The present invention relates to a spinning ring for textile yarn spinning and more specifically relates to a spinning ring having an improved bearing surface for supporting a traveler.

BACKGROUND OF THE INVENTION

In conventional spinning and twisting operations, spinning or twisting rings are used to support a traveler which moves rapidly around the circumference of the spinning ring. The traveler engages and guides a loose yarn as it is being twisted and wound onto a twisting spindle.

As the spinning speed is increased, the traveler rotates more rapidly around the surface of the spinning ring which increases the centrifugal force on the ring and creates more frictional heating. As a result, the degree of abrasive force applied to both the traveler and the spinning ring is increased as spinning speed is increased. The increased abrasive force can cause burn-off and/or shortening of the lifetime of the traveler, and also typically decreases the lifetime of the spinning ring because the bearing surface can spall, chip or otherwise become roughened.

Increases in spinning speed in ring spinning operations can also cause more breaks in the yarn being spun or twisted due to the increased frictional and abrasive forces between the traveler and the ring. Yarn breaks are particularly undesirable because of the resultant downtime in the twisting operation. In general, for a given combination of spinning ring and traveler, there is a practical spinning speed limit which cannot be exceeded without frequent breakage of the yarns being spun or twisted, and thus traveler and spinning ring construction can have a substantial impact on manufacturing efficiency.

In order to improve the durability and available spinning speed of spinning rings and travelers, numerous different modifications of the traveler bearing surface and/or the spinning ring bearing surface have been proposed, attempted, and used commercially. In some cases, increasing the durability of the spinning ring bearing surface and/or the traveler bearing surface can result in decreasing the maximum spinning speed available to the operator of the equipment. In other cases, traveler life can be shortened considerably. Yet other modifications appear promising initially but fail after a period of several months.

Recently, there has been substantial research and development effort in applying ceramic coatings and co-deposited metal/abrasion resistant materials to the bearing surface of spinning rings because these coatings have a superior hardness and a superior durability. In practice, spinning rings having a ceramic traveler bearing surface require a substantial break-in period. During the break-in period the bearing surface of the spinning ring is conditioned by contact with a moving traveler. During this time, the spinning equipment is operated at a low spinning speed because the surface of the spinning ring is initially too rough to allow the spinning equipment to run at high speed. In many cases, the break-in period for high durability, high speed spinning rings can last up to a month or longer. In addition, because of the characteristics of the bearing surface of such spinning rings, it is often necessary to use specially coated travelers in combination with such spinning rings. For example, spinning rings which have an extremely hard traveler bearing surface tend to produce substantial wear on the traveler bearing surface unless the traveler is also coated with a surface coating of increased hardness. In turn, the spinning operation is constrained to a limited selection of travelers that may not always be readily available. The manufacturing complexity and costs associated with these coatings on spinning rings and travelers is also undesirable. In addition to costly and complex ceramic coatings, numerous complex alloy coatings and/or constructions have been proposed for spinning rings.

In sum, even in the case of technically successful spinning ring modifications for increasing the durability and useful spinning speed of the spinning ring, the modifications have typically required costly and sophisticated coating processes, modification to the travelers used with the spinning rings, and/or increased periods of break-in to allow the spinning ring to be used at normal productivity spinning speeds.

SUMMARY OF THE INVENTION

The present invention provides spinning rings having an improved traveler bearing surface. The spinning rings of the invention can be used at high productivity spinning speeds without spalling or cracking of the bearing surface of the spinning ring. Although these spinning rings have an extremely hard and durable surface, the break-in time required for spinning rings of the invention is typically a short period of time ranging from about one day to about several days. Moreover, despite their hard surface, these spinning rings typically decrease the wear and abrasion on conventional travelers.

The spinning rings of the invention comprise an electroplated, hard nodular chromium coating having a thickness of between about 0.05 mil (0.00005 in.) and about 1.5 mil (0.0015 in.), preferably between about 0.1 mil (0.0001 in.) and 0.5 mil (0.0005 in.). The chromium plating can be applied to spinning rings formed from conventional base metals such as carbon steels and steel alloys. In preferred embodiments of the invention, the nodular chromium electroplated spinning ring of the invention is treated in a polishing operation prior to use. The polishing operation increases the surface smoothness of the spinning ring and thereby decreases the break-in period required for the spinning ring. However, the spinning rings of the invention can be used without a polishing treatment while nevertheless still providing a break-in time substantially less than various conventional high hardness, high durability spinning rings.

In preferred embodiments of the invention, the chromium coating applied to the spinning ring surface has a hardness exceeding about 1,000 Vickers hardness. Despite the extremely hard surface of the spinning ring, the spinning ring can be used with conventional travelers while typically increasing the useful life of the travelers. Moreover, the break-in time is short.

In contrast to the complexity of the structures and manufacturing costs associated with commercially available high durability, high hardness spinning rings which are typically formed from complex alloy structures and/or ceramic materials, the spinning rings of the invention are prepared employing a relatively simple and straightforward, and relatively inexpensive process. In one preferred embodiment of the invention, the hard nodular electroplated chromium coating can be applied by the widely available ARMOLOY process that is relied upon throughout various industries for providing thin, dense chromium coatings. The ARMOLOY process is available through franchised ARMOLOY dealers widely dispersed throughout commerce. Alternatively, nodular chromium electroplated coatings can be applied using other known technologies. Although conventional decorative bright chrome plating as is used on automotive bumpers, and the like, tends to quickly spall and chip from the surface of a spinning ring, the nodular chromium electroplated coating used in the present invention is strong and durable. In the as-plated state, nodular chromium platings exhibit a gray-to-silver-colored matte finish, as compared to the bright, shiny and smooth surface exhibited by the conventional decorative chromium plating. Although not wishing to be bound by theory, it is believed that in the case of nodular chromium plating, the individual chromium nodules are bound more tightly to the surface of the spinning ring than to adjacent nodules of chromium so that stresses applied to the surface of the spinning ring are localized and not transmitted substantially along the coating. Accordingly, it is believed that the stresses are instead, transmitted to the underlying structural materials used to form the main body of the spinning ring with the net result that the stresses do not cause propagation of fractures along the chromium coating so that fatigue weakening of the coating is minimized.

BRIEF DESCRIPTION OF THE DRAWINGS

In the drawings which form a portion of the original disclosure of the invention.

DETAILED DESCRIPTION OF THE PREFERRED EMBODIMENT

In the following detailed description, preferred embodiments of the invention are described to enable practice of the invention. Although specific terms are used to describe and illustrate the preferred embodiments, such terms are not intended as limitations on practice of the invention. Moreover, although the invention is described with reference to the preferred embodiments, numerous variations and modifications of the invention will be apparent to those of skill in the art upon consideration of the foregoing and the following detailed description.

Figure 1:
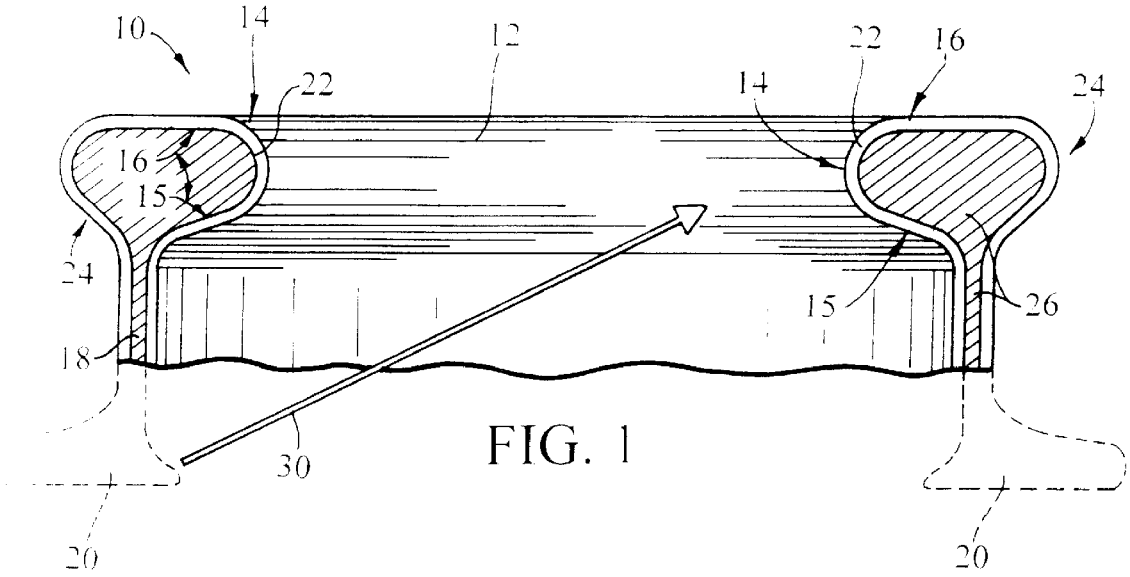
FIG. 1 is an enlarged fragmentary cross-sectional view illustrating the flange portion of a spinning ring according to the invention that receives and guides a traveler, and illustrates the nodular chromium plating thereon.

FIG. 1 illustrates an upper flange portion of a spinning ring 10 according to the invention. The spinning ring 10 includes an annular flange 12 for supporting and guiding a traveler (not shown). The spinning ring includes a traveler bearing surface 14 located on the interior circumferential surface thereof located between the areas 15 and 16 shown in FIG. 1. The flange 12 of the spinning ring 10 is supported by a relatively narrow vertical or neck portion 18, which in turn connects the flange 12 to a lower mounting flange or similar adaptor 20, shown in phantom in FIG. 1. The mounting flange or adapter 20 can have numerous and varying shapes and is used for mounting of the spinning ring 10 to the ring rail of a spinning apparatus as will be apparent to the skilled artisan. The shape and structure of the mounting adapter 20 will vary depending on the construction of the particular spinning equipment as is also known to the skilled artisan. In some cases, the ring 10 can be a reversible ring having a second flange 12 (not shown) at the lower portion of the spinning ring when the spinning equipment is constructed to mount the spinning ring via a second flange 12.

It will be further apparent to the skilled artisan that flange 12 can have any of various cross-sectional shapes for cooperating with a traveler positioned about the flange 12. The spinning ring 10 can likewise incorporate any of the various shapes and structures known in the art in connection with vertical and horizontal rings and with reversible and non-reversible rings, as will also be apparent.

Returning now to FIG. 1, at least the traveler bearing surface 14 of the flange 12 comprises a nodular chromium coating 22. Typically, the chromium coating 22 can also be present on other portions of the spinning ring such as exterior surfaces 24 of the flange and/or interior and exterior surfaces of the neck 18 of the spinning ring. The extent of the chromium coating can be controlled through the use of shaped anodes and masking treatments for the surfaces of the base as will be apparent. In accord with the present invention, the traveler bearing surface 14 comprises a hard nodular electrodeposited chromium coating having a thickness of between about 0.05 mils and about 1.5 mils, preferably between about 0.1 and about 0.5 mils. The basis metal forming the base portion 26 of the spinning ring 10 is preferably formed of an alloy steel such as AISI 52100 hardened to a hardness of Rc60 (700 Vickers) but may also be formed of various other materials such as various ferrous alloys that preferably have a hardness of at least about Rc50 (about 600 Vickers) or higher, preferably at least about Rc60 (about 700 Vickers) or higher. The high hardness is preferred to support the thin nodular chromium coating on the surface.

Figure 2:
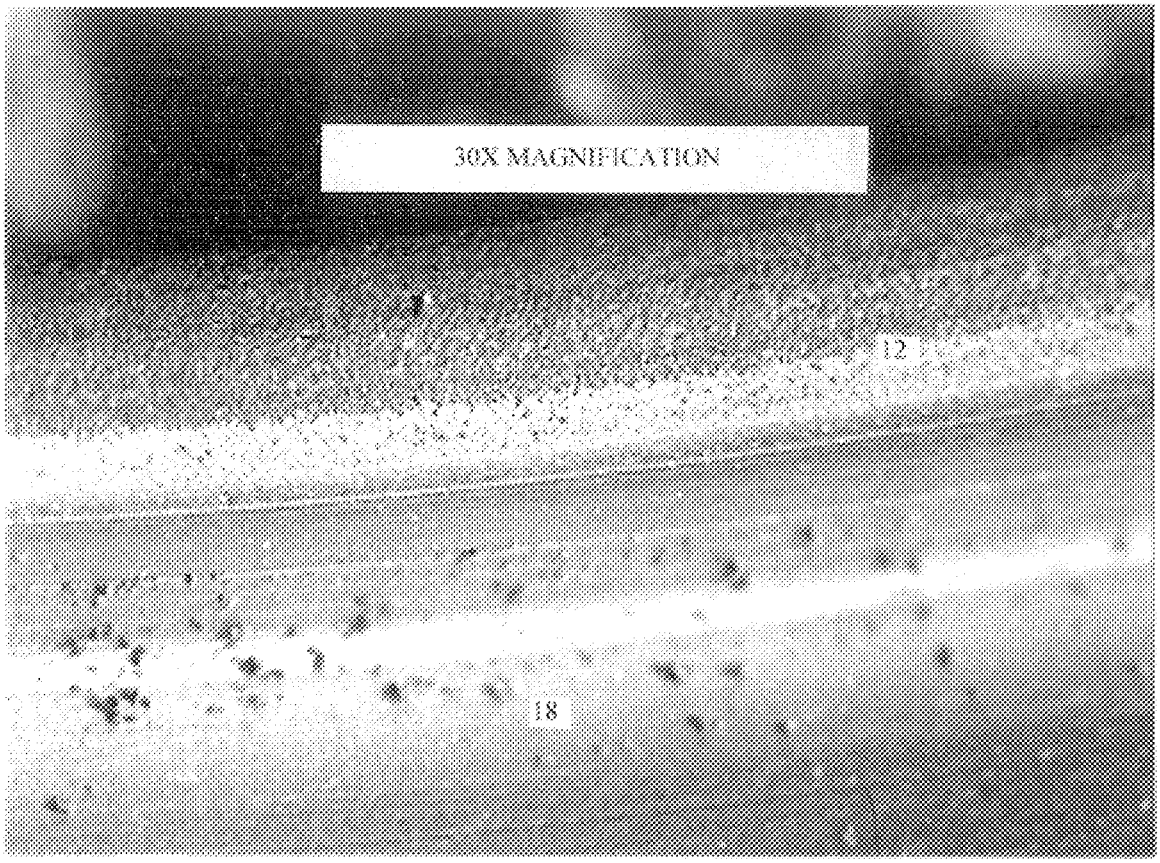
FIG. 2 is a low magnification optical photo of the interior flange surface of a nodular chromium plated spinning ring according to the invention, viewed from the direction indicated in FIG. 1.
Figure 3:
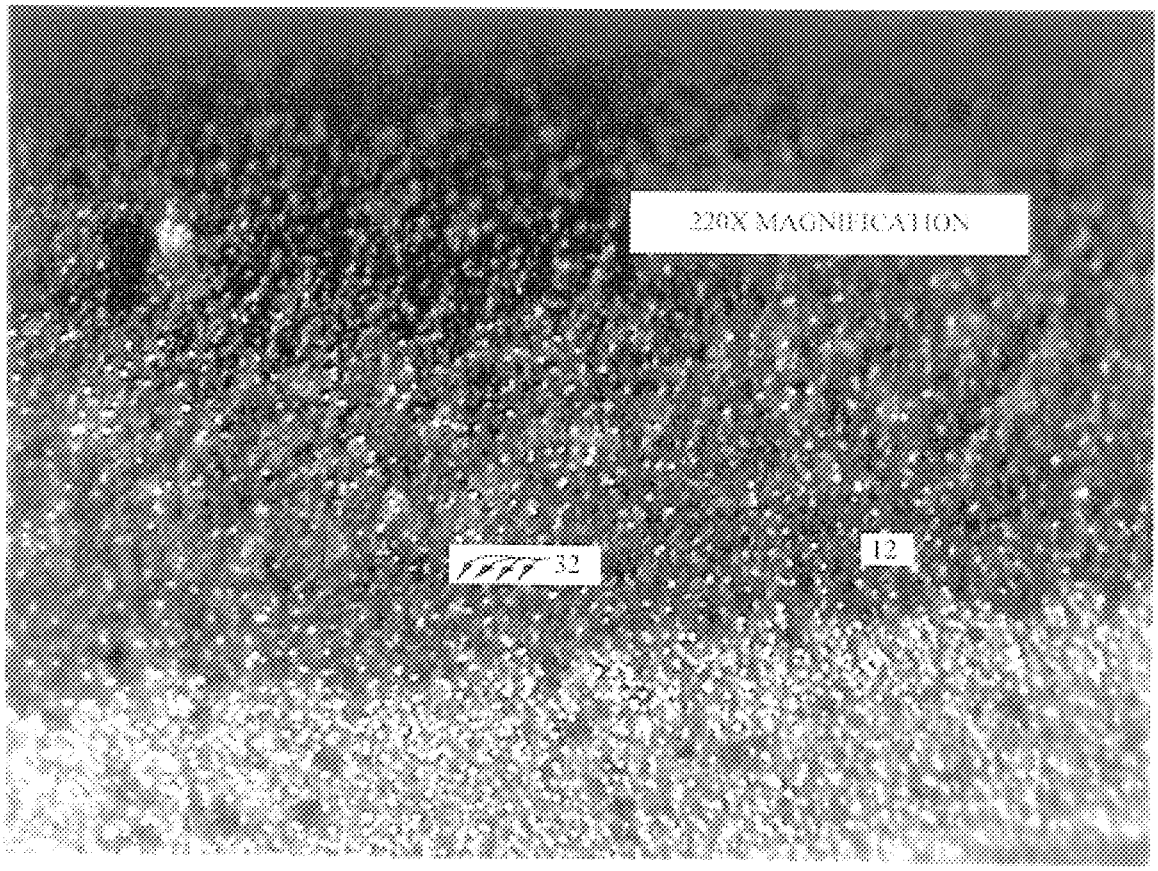
FIG. 3 is a highly magnified optical photo of the chromium surface shown in FIG. 2 and illustrates the nodular structure of the electroplated chromium coating.

Referring now to FIG. 2 and FIG. 3 a 30× optical photo of a plated flange of a spinning ring taken by viewing the spinning ring in the direction generally indicated by arrow 30 in FIG. 1 is shown. As seen in FIG. 2, the surface of flange 12 is covered with a plurality of nodular chrome deposits. The individual nodular chrome deposits 32 are best seen in the 220× optical photo of FIG. 3 and are distributed across the surface of the flange 12 as shown in FIG. 3.

The hard nodular chromium coating can be applied by the commercially available ARMOLOY process which, in turn, is available through franchised ARMOLOY dealers that are widely dispersed throughout U.S. and foreign commerce. A listing of ARMOLOY dealers can be obtained from Armoloy Corporation, DeKalb, Ill. The ARMOLOY process is a proprietary chromium electroplating process that produces a nodular chromium coating having a hardness in excess of 1,000 Vickers hardness. The finish generally appears as a gray or satin-silver matte finish in the as-plated state.

Alternatively, hard nodular chromium electroplated coatings can be applied from a solution containing chromic acid ($CrO_3$) and a catalytic anion as known to those skilled in the art and described, for example, in "Hard Chromium Plating" by Hyman Chessin and Everett H. Fernald, Jr., published in *Metals Handbook*, Ninth Edition, Vol. 5, "Surface Cleaning, Finishing, and Coating", pages 170–187, which is hereby incorporated by reference. As discussed therein, nodular chromium coatings of exceptionally high hardness are obtained using high current densities in plating baths employing a mixed catalyst bath. Other processes that are believed to provide extremely hard nodular chromium platings are described in U.S. Pat. No. 4,090,226 to Lang et al., which is hereby incorporated by reference and U.S. Pat. No. 4,717,456 to Chessin et al., which is also incorporated herein by reference. As discussed in the above patents and publication, it is generally desirable to pretreat the surface to be electroplated by cleaning and surface activation prior to the electroplating process. Surface activation processes include anodic etching in the chromium-plating bath or in a separate chromic acid bath as described in the above-identified Chessin et al. article at pages 180–181.

Yet another process that can be used to provide an electroplated nodular thin dense chromium coating is commercially available from Implant Sciences Corp., Wakefield, Mass., as NITRO-CHROME. This process is a combination of thin, dense chromium plating and nitrogen ion implantation. The nodular thin, dense chromium plating process deposits a micro-nodular structured chromium directly on the base metal. Nitrogen ion implantation is a surface pretreatment in which the surface of the metal is drastically modified by energetic ions of nitrogen.

In a preferred embodiment of the invention, the hard nodular chromium electroplated spinning ring of the invention is treated in a polishing operation prior to use thereof. In general, polishing is preferably carried out by treating the plated spinning ring with a polishing abrasive such as alumina in any of various vibratory polishing processes including harperizing processes and the like. Preferably, the degree of polishing is such that at least some of the nodular surface is retained. In this regard, the nodular surface may assist in reducing the break-in time for the spinning rings of the invention. In general, polishing is preferably conducted until the gray, matte finish is changed to a silver matte or satin, but not mirror, finish.

Figure 4:
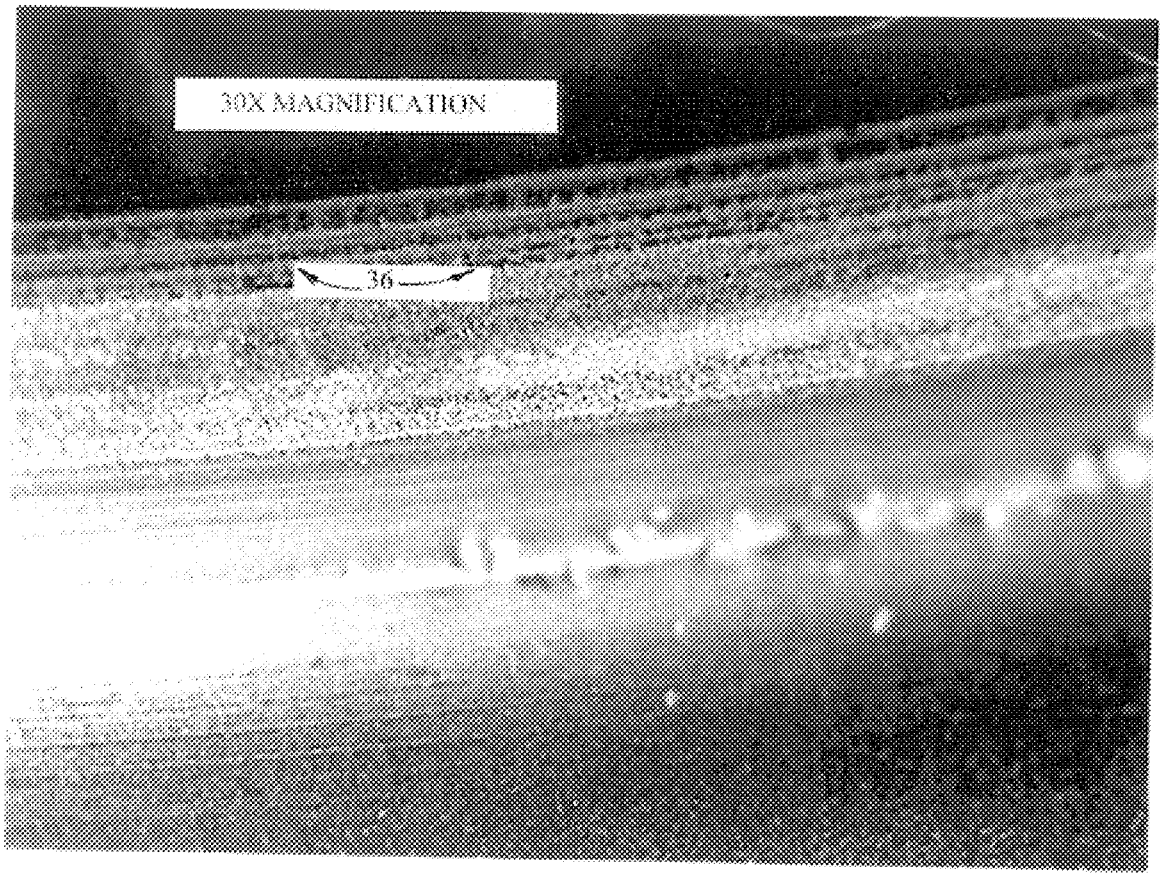
FIG. 4 is a low magnification optical photo of a portion of the interior flange surface, corresponding to the surface portions illustrated in FIGS. 2 and 3, of a polished and partially worn spinning ring according to the invention.
Figure 5:
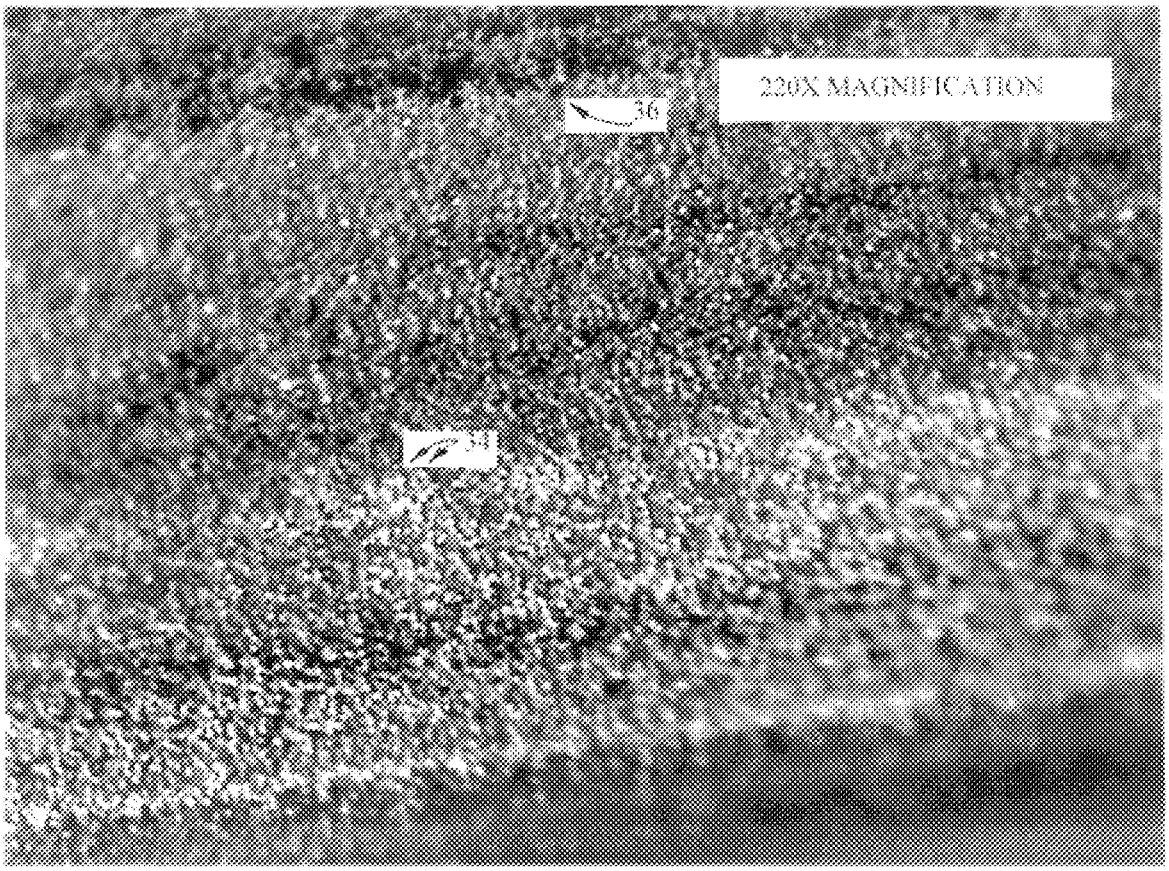
FIG. 5 is an enlarged optical photo of the surface of the spinning ring shown in FIG. 4 and illustrates the changed nodular surface resulting from the polishing operation, along with the additional enhanced smoothing along that portion of the surface of the spinning ring contacted by a traveler.

FIGS. 4 and 5 illustrate 30× and 220× magnification optical photos, respectively, of a portion of the interior flange surface of a polished and partially worn spinning ring according to the invention. With reference to these figures, it will be seen that the polishing treatment applied to the nodular chrome surface has reduced the degree of grain separation of the individual polished nodules 34. In addition, a path 36, wherein the nodular chromium has been worn to a smooth state, can be seen. The path 36 has been formed by contact between the spinning ring and a moving traveler over a period of about one day. The path is dark, indicating that oils and other materials have been collected along the smooth path to provide a self-lubricating effect. As indicated, the smooth path 36 was formed during a one day use of the spinning ring. Thus, it will be apparent that the break-in time required for spinning rings according to the invention is substantially reduced, as compared to other spinning rings of high surface hardness.

In actual experience with the spinning rings according to the invention, the lifetime of conventional travelers has been increased by a factor of 2, 3 or even higher. This observation was made in a mill spinning carded cotton (36 NE) at approximately 17,000 RPM employing the spinning rings of the invention and conventional steel-based spinning rings. The spinning rings of the invention can be used in the conventional manner and with the same travelers as are used with steel spinning rings. It has been found with the spinning rings of the invention that travelers of lighter weight can be substituted for the travelers normally used with conventional steel spinning rings in order to achieve high productivity spinning speeds. It will be apparent, however, that the spinning rings of the invention can be employed with various weight travelers and with many different travelers of numerous constructions as are conventionally used in the art.

The properties of the spinning ring of the invention are believed to improve over a time of up to about one month or more, following which time the spinning ring can be used at yet higher productivity spinning speeds. The spinning rings of the invention have been found capable of operating at extremely high spinning speeds of 7,500 feet per minute and higher without causing frequent yarn breaks. Nevertheless, examination of the surface of the spinning rings shows no cracking or spalling. In addition, traveler life is improved during high spinning speed usage of the spinning rings of the invention.

The invention has been described in considerable detail with reference to its preferred embodiments. However, numerous variations and modifications can be made within the spirit and scope of the invention without departing from the invention as described in the foregoing specification and defined in the appended claims.

That which is claimed:

1. A textile spinning ring comprising a flange of a base material for receiving a traveler, said flange comprising a circumferential bearing surface for said traveler, said bearing surface comprising an electrodeposited coating of hard, nodular chromium having a thickness of between about 0.05 mils and about 1.5 mils.

2. The spinning ring of claim 1 wherein said electrodeposited hard, nodular chromium coating has a thickness of between about 0.1 and about 0.5 mils.

3. The spinning ring of claim 2 wherein said hard, nodular chromium coating has a hardness exceeding about 1,000 Vickers.

4. The spinning ring of claim 3 wherein said flange is formed of a ferrous alloy base metal having a hardness of at least about 600 Vickers.

5. The spinning ring of claim 3 wherein said flange is formed of a ferrous alloy base metal having a hardness of at least about 700 Vickers.

6. The spinning ring of claim 2 wherein said flange is formed of a ferrous alloy base metal.

7. The spinning ring of claim 6 wherein said flange is formed of a steel.

8. The spinning ring of claim 7 wherein said ferrous metal base alloy has a hardness of at least about 600 Vickers.

9. The spinning ring of claim 1 wherein said flange is formed of a ferrous alloy base metal.

10. The spinning ring of claim 1 wherein said hard nodular chromium coating is applied by an ARMOLOY process.

11. The spinning ring of claim 1 wherein said hard nodular chromium coating is polished sufficiently to increase the smoothness of the surface of said chromium coating and to retain at least a portion of the nodular surface of the nodular chromium coating.

12. The spinning ring of claim 1 wherein said hard, nodular chromium coating has a hardness exceeding about 1,000 Vickers.

13. The spinning ring of claim 12 wherein said flange is formed of a ferrous alloy base metal having a hardness of at least about 600 Vickers.

14. The spinning ring of claim 12 wherein said flange is formed of a ferrous alloy base metal having a hardness of at least about 700 Vickers.

* * * * *